United States Patent [19]

Datson

[11] Patent Number: 4,856,207

[45] Date of Patent: Aug. 15, 1989

[54] SHOE AND GAITER

[76] Inventor: Ian A. Datson, 68 Caulfield Ave., Cumberland Park, Australia, 5041

[21] Appl. No.: 164,211

[22] Filed: Mar. 4, 1988

[30] Foreign Application Priority Data

Mar. 4, 1987 [AU] Australia ..... PI0668

[51] Int. Cl.[4] ..... A41D 17/00; A43B 3/00; A43B 1/14

[52] U.S. Cl. ..... 36/2 R; 36/1.5; 36/45; 36/87; 36/50

[58] Field of Search ..... 36/2, 1.5, 4, 83, 3 A, 36/3 R, 45, 50, 87

[56] References Cited

U.S. PATENT DOCUMENTS

| | | | |
|---|---|---|---|
| 296,495 | 4/1884 | Williamson | 36/45 X |
| 352,836 | 11/1886 | Oldberg | 36/50 |
| 984,608 | 2/1911 | Roberts | 36/2 R |
| 1,608,214 | 11/1926 | Janke | 36/2 R |
| 2,458,952 | 1/1949 | Malluk | 36/45 |
| 3,286,375 | 11/1966 | Troy | 36/2 R |
| 3,618,232 | 11/1971 | Shnuriwsky | 36/1.5 |
| 4,244,121 | 1/1981 | Adams | 36/2 R |

FOREIGN PATENT DOCUMENTS

| | | | |
|---|---|---|---|
| 3147202 | 6/1983 | Fed. Rep. of Germany | 36/3 A |
| 2390120 | 12/1978 | France | 36/50 |
| 2488788 | 2/1982 | France | 36/87 |
| 2539276 | 7/1984 | France | 36/2 R |
| 193601 | 1/1938 | Switzerland | 36/1.5 |

OTHER PUBLICATIONS

W. L. Gorg & Associates, Inc., Letter from File Wrapper of U.S. Pat. No. 4,550,446.

*Primary Examiner*—James Kee Chi
*Attorney, Agent, or Firm*—Klauber & Jackson

[57] ABSTRACT

A boot or shoe has a gaiter, the lower end of which is permanently affixed by a waterproof join to the boot or shoe's outer surface, circumscribing the said boot or shoe above the sole. The gaiter has an opening extending down from the top, and a fastener, which when closed helps to keep the gaiter in an upright position on the wearer's leg. A gusset is disposed inwardly of the opening and forms a tubular shape when the fastener is closed. A pull cord or other closure at the top of the gaiter is operable to constrict the gaiter's upper periphery around the wearer's leg. This closure inhibits the flow of water into the boot or shoe. When not required, the gaiter folds down around the ankle of the wearer's leg.

9 Claims, 4 Drawing Sheets

SHOE AND GAITER

This invention relates to a sturdy shoe (which term is used herein generically, and includes a boot), and a gaiter attached thereto, arranged to inhibit entry of water into the boot or shoe if worn across wet and swampy ground, or through shallow creeks and rivers or in heavy rain.

BACKGROUND OF THE INVENTION

Gaiters of various types have been used heretofore but as far as is known to the applicant, all have failed to successfully repel water from entry into a shoe or down the leg of a user when crossing shallow creeks or in very wet swampy ground. All gaiters known to the applicant are separate from their shoes and have the effect of shedding only some of the water. More sophisticated ones are specially designed for use with specific brands of shoes but they are still separate entities and have only been partially successful in inhibiting entry of water.

The main object of this invention is to provide an improved gaiter which will be very much more effective in reducing the amount of water which will enter a boot or shoe under adverse conditions of use.

BRIEF SUMMARY OF THE INVENTION

In this invention, a shoe has a gaiter permanently fixed to it so that a water-tight compartment can be formed by the gaiter in conjunction with its boot or shoe. It is characterised, inter alia, in that the two items, shoe and gaiter, which are normally separate entities, are joined to form a single article of waterproof footwear. This article performs with the full range of functional characteristics of a shoe yet has the added property of being able to inhibit entry of water from the wearer's leg or otherwise entering his shoe, more effectively than any gaiter at present known to the applicant.

This has been made possible by two features: a permanent but waterproof join which joins the gaiter to the shoe and circumscribes said boot or shoe above the sole; and a gusset.

The waterproof join inhibits entry of water into the gaiter from underneath at the lower end of the gaiter. No other detachable gaiter at present known to the applicant effectively achieves this.

More specifically, the invention consists of a shoe and gaiter, said gaiter having a lower end and an upper end, a waterproof join between the gaiter lower end and the outer surface of the footwear, and circumscribing the footwear above its sole, said gaiter comprising a vertically extending gusset, and fastener means which, when fastened, close the gusset to a tubular shape, and closure means at the upper end of the gaiter movable to constrict or release the periphery of the gaiter upper end.

The gusset has the function of preventing water which passes the gaiter's opening from entering the gaiter around the leg and running into the boot or shoe of a user while at the same time permitting all the operations necessary to the proper function of any boot or shoe.

The effect of the gusset is to increase the circumference when the gaiter is undone and rolled down, so that the gusset allows (a) access to and manipulation of those boot or shoe fasteners which are within the gaiter, and (b) withdrawing of the tongue of the boot or shoe sufficiently for easy fitting when the boot or shoe is being taken on or off.

Further, by reducing the circumference of the gaiter when it is fastened, the gusset allows the gaiter to assume a comfortable close-fitting shape of neat appearance around the leg and at the same time assists in keeping the gaiter in an upright position on the wearer's leg.

In addition, the gusset makes possible an easy-to-manipulate, flush fitting and neat looking fold-down into a "self-housing" when the gaiter is not in use.

BRIEF DESCRIPTION OF THE DRAWINGS

An embodiment of the invention is described hereunder in some detail with reference to and as illustrated in the accompanying drawings in which.

Figure 1:
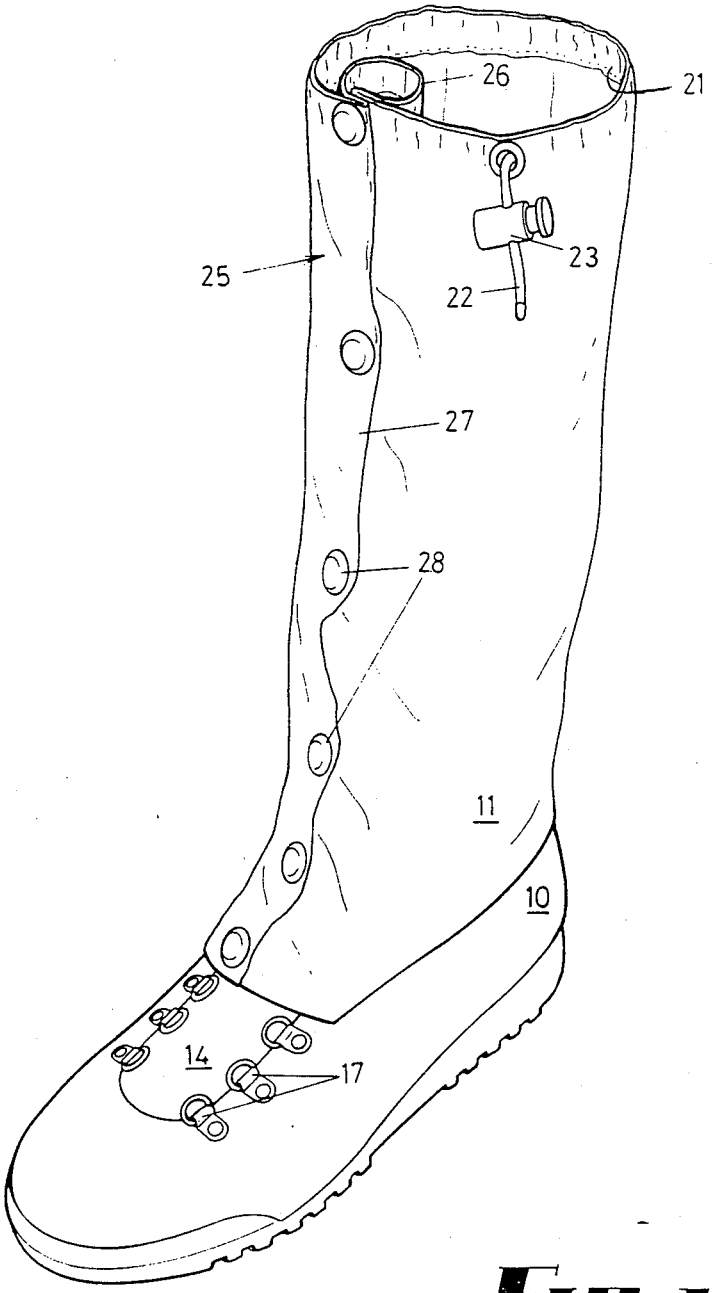
FIG. 1 is a perspective view of a boot and gaiter in accordance with this invention, when the gaiter is extended to cover the leg of a user.

In this embodiment a boot 10 and gaiter 11 are joined by a join, illustrated as a layer of waterproof cement 12 which circumscribes the boot. In the event that the join includes stitching, the stitching holes are filled with a cement to render the stitching waterproof.

The boot is provided with a pair of spaced lacing flaps 13 extending up from the instep portion, and an external tongue 14 cemented to the lower ends of the flaps bridges the gap between them to inhibit inflow of water at that locality. The cement layer 12 separates one set of lace retaining D-rings 16 from a lower set of D-rings 17, the lower set being contiguous with the upper surface of the external tongue 14. An upper boot lace 18 is retained by the upper set of D-rings 16 and a lower boot lace 19 is retained by the lower D-rings 17.

The upper end of the gaiter is provided with a hem 21 which forms a tubular sleeve surrounding the upper end, and this tubular sleeve contains a pull cord 22 which is capable of constricting the upper end of the gaiter, or releasing it. The pull cord 22 is releasably engaged by a retainer 23 of a type already well known and in common use.

Figure 2:
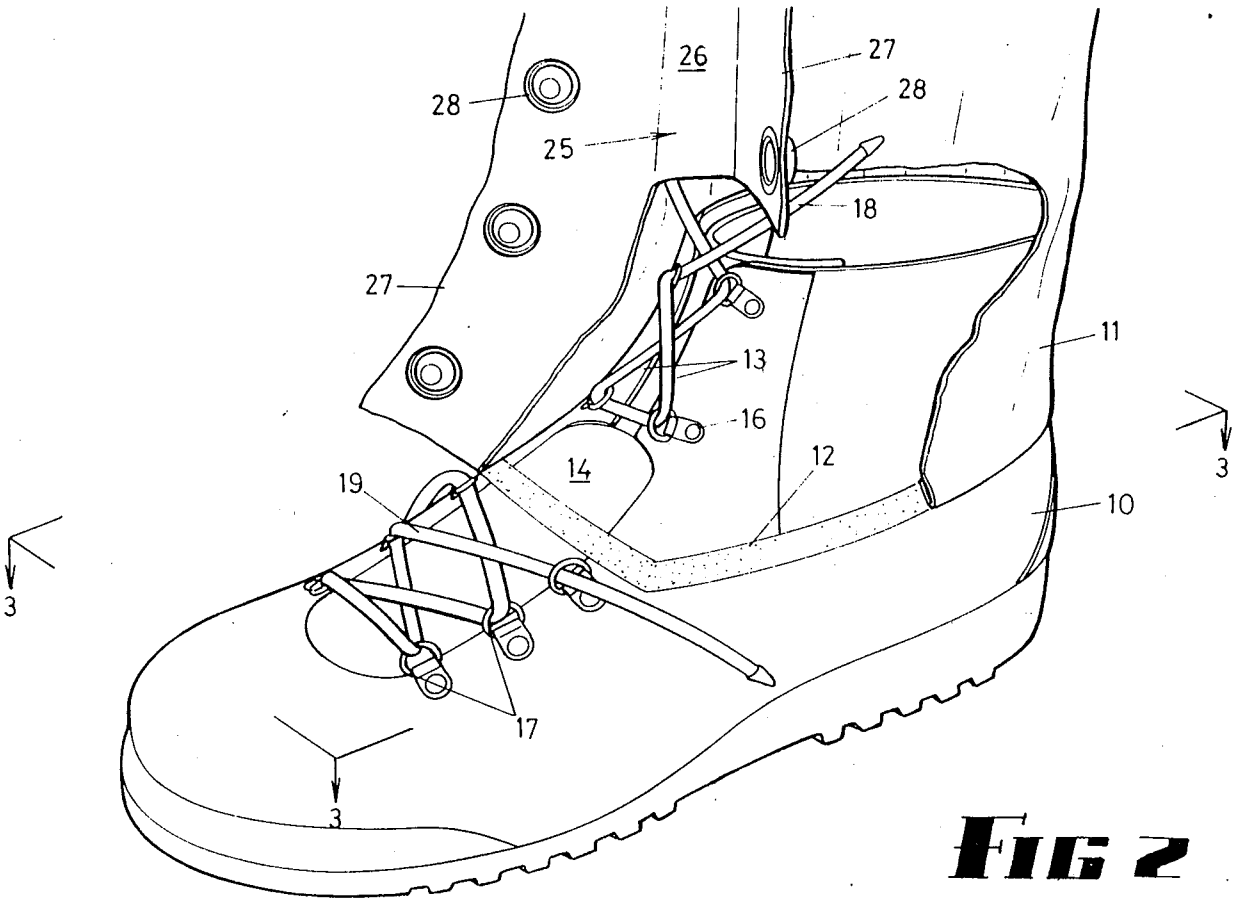
FIG. 2 is a view drawn to a larger scale, showing the gaiter "broken" so as to disclose the upper part of the boot, and a layer of cement which is used to secure the lower end of the gaiter to the boot.
Figure 3:
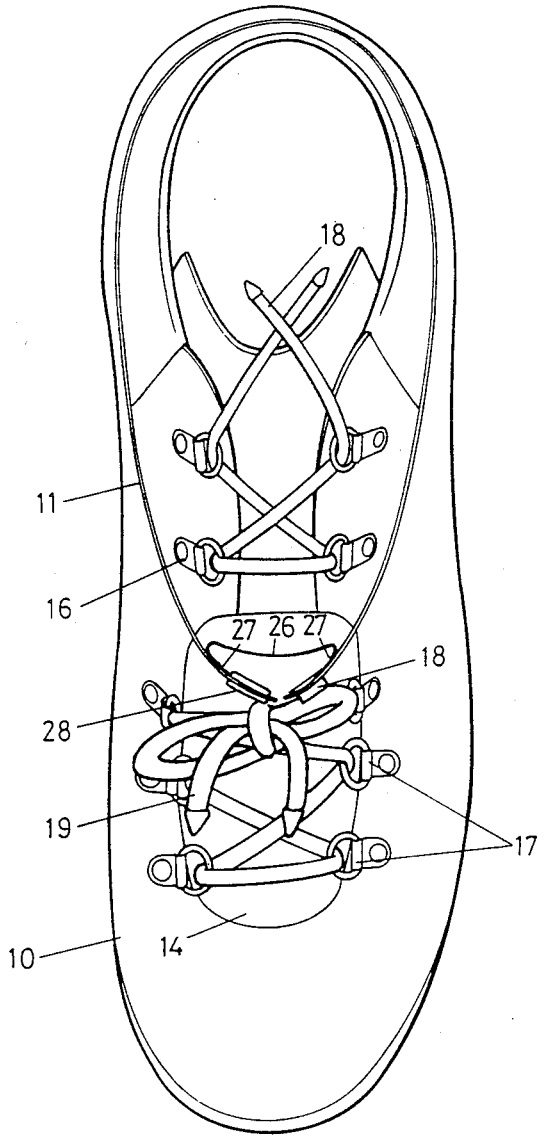
FIG. 3 is a plan view of the boot, but taken on section 3—3 of FIG. 2, showing the shape of the gaiter at the glue line.
Figure 5:
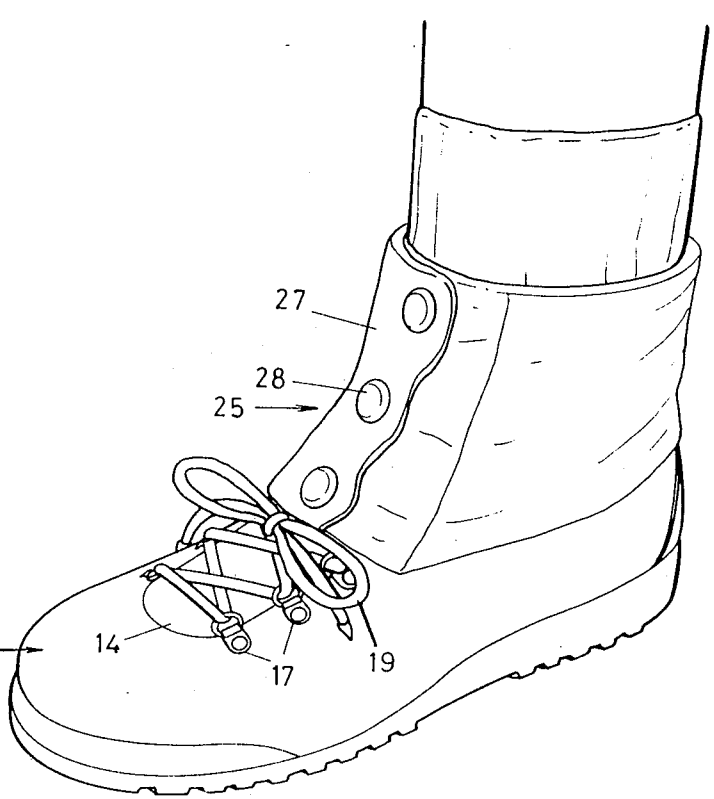
FIG. 5 is a perspective view similar to FIG. 4, but showing the gaiter with the fasteners closed, when used "rolled down".
Figure 4:
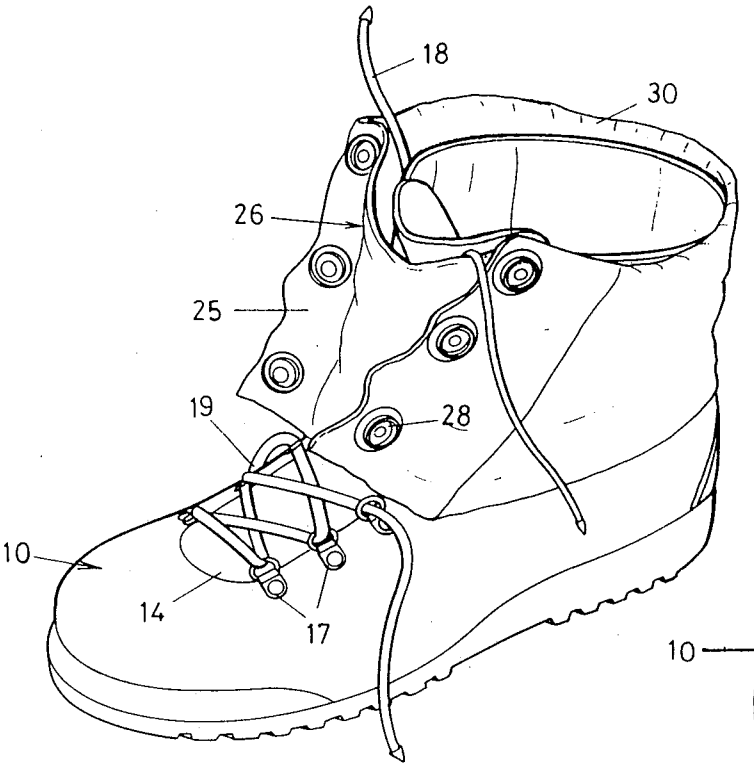
FIG. 4 shows the gaiter when in its rolled down state.

A forwardly facing portion 25 of the gaiter 11 is provided with a gusset 26 which is formed by two spaced folded flaps 27 of the gaiter material, the folded flaps being cemented together and between the flaps the gusset is so cemented to the boot by the cement 12 as to inhibit entry of water. (Stitching and sealing of needle holes can alternatively be used.) The folded flaps can be folded and retained contiguous with one another by means of stud-type fasteners 28, whereupon the gusset 26 takes a tubular form as best seen in FIG. 1. This is the condition under which the gaiter is normally worn. However when the stud-type fasteners 28 are released as best seen in FIG. 2, the effective diameter of the gaiter is greatly increased. This allows the gaiter 11 to be rolled down into a roll 30 as shown in FIG. 4, whereupon the upper boot lace 18 can be manipulated. It also enables a wearer to quickly and easily release his gaiter when it is not required. However when the gaiter is in the wearing position as shown in FIG. 1, the existence of the gaiter causes at least three thicknesses of the gaiter material to overlie the shin portion of the wearer.

The gaiter material used in this embodiment comprises a laminate of micro-porous polytetrafluoroethylene sheet sandwiched between two sheets of woven material. Such a product is available from W. L. Gore & Associates (U.K.) Ltd. of Scotland under the Registered Trade Mark GORE-TEX. The microporous PTFE sheet or membrane discriminates between water in droplet form and water in vapour form, allowing water vapour to pass through but inhibiting flow of liquid water. This is a useful characteristic for the comfort of a wearer, and renders the gaiter substantially waterproof. The layer of cement 12 is also a waterproof layer which inhibits flow of water into the boot, and if required any apertures which exist in the stud-type fasteners 28 can be closed with a mastic or resinous material. However as will be seen from the drawings, penetration of water through the stud-type fasteners will not allow water to enter the boot, such entry being inhibited by the material of the gusset at 26.

The above embodiment has been described with respect to the rugged stud-type fasteners and gusset extending down a forwardly facing portion of the gaiter 11.

In the description and illustration, the tongue shown is an external tongue 14. In some instances however an internal tongue can also be used with the boot.

This invention is applicable to those boots and other types of shoes which by virtue of their use (in snow, mud, swamp, bog or other wet terrain) could reasonably be expected to be used with gaiters. Such boots and shoes fall into two categories:

boots and shoes with tongues and associated fastener means, and boots and shows without tongues. The boots and shoes of the first category (i.e. with tongues) can be sub-classified into two types, those whose tongues cross the flexion zone of the said boot or shoe and those whose tongues do not cross the flexion zone.

In the case of those boots and shoes whose tongues do not cross the flexion zone the permanent waterproof attachment join on the outer surface of the said boot or shoe which circumscribes the boot above the sole also fully encircles the tongue, so that the tongue and its fastener means are wholly under the gaiter with access to them provided by the gusset when the gaiter fastener is undone.

In the case of boots or shoes whose tongues do cross the flexion zones, if the tongue is of a bellows type which bridges the fastener flaps without undue folding under the flaps, the permanent waterproof attachment line goes directly across the outer surface of the tongue. Developmental work however, has shown that if there is any considerable folding under the flaps, this will cause chafing and wear on the material of the gaiter. If there is undue folding under the flaps (as is the case with some boots) an overlay or external tongue can be used to bridge the gap between the fastener flaps, as illustrated herein, and allows adequate variations in fastener adjustment but without excessive folding under the fastener flaps. The permanent waterproof attachment join goes directly across the outer surface of this overlay or external tongue.

For all boots and shoes in the category so far under discussion—boots and shoes with tongues and associated fastener means—the gusset which is situated in a central vertical plane lies most naturally at the front above the tongue. It is however possible to position it at the rear or on the sides if it is wished to protect the gaiter fastener from abrasion and tearing in rough terrain. For boots in the second category—i.e. boots and shoes without tongues—the gusset may lie either at the front or again be located on the side or at the heel, to enable access to the boot or shoe fastener and the manipulation of that fastener.

For boots and shoes in this category, the waterproof attachment join which goes across the outer surface of said boot or shoe circumscribing it above the sole, encircles the boot or shoe fastener in the same manner that it encircled the tongue on boots and shoes whose tongues do not cross their flexion zones.

Different applications of this invention have been subjected to strenuous and extensive field tests. For example a Scarpa Trionic Mirage walking boot (manufactured by Calzaturifico Scarpa Vialetiziano, Italy) is a boot with a tongue which crosses the flexion zone, and was mounted with a gaiter in the manner described for this type of boot. The boot was tested for 12 hours a day for five weeks in Tasmania's Cradle Mountain—Lake St. Clair National Park—an area notorious for its mud bogs, swamps, water-flooded tracks, numerous creek crossings and snowfalls, and the results were outstanding.

Extensive developmental work of this type has clearly shown that the best method of performing the invention depends on the purposes for which it is to be used. For example, whether it is better to use a "touch and hold" fastener as that sold under the Registered Trade Mark "VELCRO", to fasten the gaiter opening, or whether a plurality of studs is to be preferred depends on the type of terrain for which the invention is required. If the terrain is muddy, swampy or heavily grassed etc. then studs are to be preferred, because they do not clog with mud, grit or other debris. If on the other hand the invention is to be used for frequent creek crossings in relatively clean areas then Velcro type fastener may be preferred because it is easier and quickler to open and close.

Similarly for the gaiter material. If the invention is to be used for wading through swamps and creeks encountered only occasionally, then any material which is impermeable to water (e.g. a coated nylon) works as well as anything else provided that the boot or shoe is a leather one.

On the other hand, if the invention is to be used for walking in and out of water constantly (as is the case in Tasmania's national parks) or for walking for long periods in heavy rain conditions (using overpants or a raincoat to cover the top of the gaiter) a polytetrafluoroethylene membrane which has been laminated to one or two layers of fabric such as that sold under the Registered Trade Mark "GORE-TEX", is the best.

Again, it is the same for the boots. If prodigious amounts of walking in swampy terrain are contemplated then a one piece leather boot with a padded tongue functions well. But such a boot is inferior to an elastic-sided riding-boot if the purpose is horse-riding in wet, swampy or snow-covered country. Yet the functions of both types of boots are improved by the mounting of gaiters of the type outlined in this invention.

The claims defining the invention are as follows:

1. A shoe and gaiter, said shoe having a sole, an outer surface, an instep portion, a pair of lacing flaps extending up the instep portion, and lace retention means on the lacing flaps, said gaiter being of flexible foldable material and having a lower end, an upper end, a vertically extending gusset, and fastener means which, when fastened, closes the gusset to a tubular shape, a continuous waterproof join between the gaiter lower end and the outer surface of the shoe at the locality of said instep portion and circumscribing the shoe above its sole, said gaiter being sufficiently imperforate between its upper and lower ends that the shoe and gaiter comprise a waterproof combination, and closure means at the upper end of the gaiter movable to constrict or release the periphery of the gaiter upper end.

2. A shoe and gaiter according to claim 1 wherein said gusset comprises a pair of spaced gusset flaps which extend up a forwardly facing portion of the gaiter, said fastener means comprise a plurality of study-type fasteners which are carried on the gusset flaps, each said gusset flap comprising a folded portion of gaiter material having cement joining contiguous faces.

3. A shoe and gaiter according to claim 1 or claim 2 wherein said gaiter comprises pervious but waterproof material.

4. A shoe and gaiter according to claim 3 wherein said gaiter comprises a laminate of micro-porous polytetrafluoroethylene sheet sandwiched between two sheets of woven material.

5. A shoe and gaiter according to claim 4 wherein said continuous waterproof join comprises a layer of cement between the gaiter lower end and said shoe outer surface which inhibits flow of water into the boot.

6. A shoe and gaiter according to claim 5 or claim 2 wherein the closure means comprises a pull cord extending around the upper end of the gaiter, and a retainer releasably engaged by the pull cord.

7. A shoe and gaiter according to claim 6 or claim 2 wherein said lace retention means comprise D-rings secured to the lacing flaps, one set of D-rings being above and another set of D-rings being below the layer of cement, and two boot laces retained by the D-rings of respective said sets.

8. A shoe and gaiter according to claim 7, wherein said lacing flaps are spaced by a gap and comprise said lace retention means, and further comprising an external tongue bridging the gap between the lower ends of the lacing flaps, said waterproof join extending across the outer surface of the external tongue.

9. A shoe and gaiter, said boot having a sole, an outer surface, an instep portion which includes a flexion zone, a pair of spaced lacing flaps extending up the instep portion, and including lower ends, a gap between the lacing flaps, lace retention means on the flaps, and an external tongue bridging the gap between the lower ends of the flaps, said gaiter being of flexible foldable material and having a lower end and an upper end, a layer of cement adhering the gaiter lower end to the external tongue and to the outer surface of the shoe, and circumscribing the boot above its sole to create a waterproof join between the lower end of the gaiter and the shoe, said waterproof join being spaced from the flexion zone of the shoe, said gaiter comprising a forwardly facing vertically extending gusset, and fastener studs which, when fastened, close the gusset to a tubular shape, and closure means at the upper end of the gaiter movable to constrict or release the periphery of the gaiter upper end.

* * * * *